US007757614B2

(12) United States Patent
Nurse-Bey

(10) Patent No.: US 7,757,614 B2
(45) Date of Patent: Jul. 20, 2010

(54) FITTED TABLECLOTH FOR OUTDOOR USE AND ASSOCIATED METHOD

(76) Inventor: Hazel A. Nurse-Bey, 26 Hunters Creek Cir., Mullica Hill, NJ (US) 08062

( * ) Notice: Subject to any disclaimer, the term of this patent is extended or adjusted under 35 U.S.C. 154(b) by 192 days.

(21) Appl. No.: 12/148,368

(22) Filed: Apr. 18, 2008

(65) Prior Publication Data

US 2008/0257231 A1 Oct. 23, 2008

Related U.S. Application Data

(60) Provisional application No. 60/925,147, filed on Apr. 19, 2007.

(51) Int. Cl.
*A47B 13/08* (2006.01)

(52) U.S. Cl. ..... 108/90

(58) Field of Classification Search ..... 108/90; 150/158

See application file for complete search history.

(56) References Cited

U.S. PATENT DOCUMENTS 1,684,173 A * 9/1928 Diamond et al. ..... 108/90
3,279,515 A * 10/1966 Kesh ..... 108/90
4,705,084 A * 11/1987 Rodebaugh et al. ..... 108/90
4,813,166 A * 3/1989 Drake ..... 108/90
4,982,516 A * 1/1991 Cervantes ..... 108/90
5,287,614 A 2/1994 Ehrlich
5,339,748 A * 8/1994 Bilotti ..... 108/90
5,908,681 A * 6/1999 Foster ..... 150/158
6,381,812 B1 5/2002 Crider
6,986,928 B2 1/2006 Almansa Perea
2002/0178975 A1* 12/2002 Lewis et al. ..... 108/90
2007/0051285 A1* 3/2007 French et al. ..... 108/90

FOREIGN PATENT DOCUMENTS

DE 4217613 * 12/1993 ..... 150/158

* cited by examiner

*Primary Examiner*—Hanh V Tran

(57) ABSTRACT

A tensioned tablecloth includes a flexible and unitary body with a plurality of monolithically formed sides configured in such a manner to form a continuous perimeter extending about the body. The tablecloth further includes a mechanism for retaining the body at a substantially flat and taut position during inclement weather conditions such that the body is prohibited from undesirably disengaging a top surface of the existing outdoor eating surface. Such a body retaining mechanism includes a single and unitary elastic band contiguously abutted against an interior face of the sides and traveling along an entire length of the perimeter. A plurality of primary and auxiliary bands cooperate with fasteners and are removably connected to the anchor band for providing a tensioned surface along the body.

15 Claims, 7 Drawing Sheets

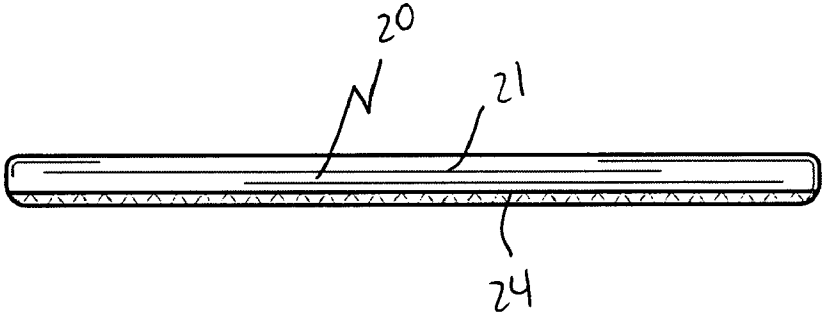
FIG. 6
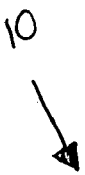

FITTED TABLECLOTH FOR OUTDOOR USE AND ASSOCIATED METHOD

CROSS REFERENCE TO RELATED APPLICATIONS

This application claims the benefit of U.S. Provisional Application No. 60/925,147, filed Apr. 19, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to tablecloths and, more particularly, to a fitted tablecloth for remaining firmly fitted on an existing outdoor eating surface during inclement weather conditions.

2. Prior Art

Nondescript tables intended to be covered before use are well known in the entertainment, convention and party industries. Typically, the underlying table is of conventional design without decorative features. The top of the table may be of any particular shape, but is usually either square or round. A set of legs is attached to the underside of the table top and are normally foldable into and out of a use configuration. The tables themselves are not attractive and are almost always covered for use. In this way, the cover may be selected so that the tables serve as a complement to the rest of the theme of an event. Usually, conventional table coverings have been simple drapes that are positioned upon the table for uniform appearance.

One problem experienced with these designs is that no reference is provided to indicate when the draped table covering has been properly positioned. Therefore, set up of such tables, especially when there is a large number can be time-consuming. Each table must be visually inspected, usually from several different vantage points, to assure that it looks right from all sides. Furthermore, such draped configurations have been in long-time use and the entertainment and party industries desire new and novel appearances, as well as efficient designs for event accessories. Also, conventional table covers have a tendency to slide about as people move or become seated about the table, thus causing the cover to become distorted.

U.S. Pat. No. 5,287,614 to Ehrlich discloses a method of attaching a decorative skirt about a banquet tablecloth using spring clips with Velcro patches in which initially the spring clips in spaced apart relation are engaged to extend radially from the tablecloth but are then pivoted, as allowed by the flexibility of the cloth, into a vertical plane in which the Velcro patches thereon face outwardly of the table and are readily attached to a cooperating Velcro strip on the decorative skirt. Unfortunately, this prior art example does not include an integrated elastic fastener for maintaining the present invention in an anchored position.

U.S. Pat. No. 6,381,812 to Crider discloses a device and method for securing a tablecloth to a picnic table. Multiple strips of elastic with hook and loop type fasteners at opposed ends of each strip provide releasable closure of the strips into binding bands, and wrap around the tablecloth and secure it to the picnic table. The releasable closure means allow the strips to be threaded through and under the supporting framework for a table or other article of furniture. The strips are sized and constructed for application to a wide range of different sized tables and other outdoor furniture. Unfortunately, this prior art example is not designed for replacing a conventional table cover.

U.S. Pat. No. 6,986,928 to Almansa Perea discloses an improved tablecloth and device for fixing the skin of the tablecloth. The tablecloth comprises an independent skirt which can be detachably held to the board of the table by means which enable a variable distribution of the fixing points, and a cover which is placed on the surface of the table board and hanging sideways and hiding the edge of the board as well as the fixing points of the skirt. The device for fixing the skirt comprises a frame which is fixed to the lower part of the table board, and at a predetermined distance from the edge of the board, remaining slightly separated therefrom by discontinuous portions which can be integral with the frame or not. A variable number of C-shaped parts are placed on the frame which embrace it and are held by means of a narrowing section configured by its own branches, thereby enabling the lateral displacement along the frame. The portions are provided externally with Velcro-type bands to be fixed with their counter-parts which are sewn to the skirt, thereby making possible the displacement of the fixing points thus formed and a regular and esthetic distribution of the folds. Unfortunately, this prior art example does not include an integrated elastic fastener for maintaining the present invention in an anchored position.

Accordingly, the present invention is disclosed in order to overcome the above noted shortcomings. The tensioned tablecloth is convenient and easy to use, lightweight yet durable in design, and designed for remaining firmly fitted on an existing outdoor eating surface during inclement weather conditions.

BRIEF SUMMARY OF THE INVENTION

In view of the foregoing background, it is therefore an object of the present invention to provide a present invention for remaining firmly fitted on an existing outdoor eating surface during inclement weather conditions. These and other objects, features, and advantages of the invention are provided by a tensioned tablecloth.

A tensioned tablecloth includes a flexible and unitary body with a plurality of monolithically formed sides configured in such a manner to effectively form a continuous perimeter extending about the body. The present invention further includes a mechanism for retaining the body at a substantially flat and taut position during inclement weather conditions such that the body is prohibited from undesirably disengaging a top surface of the existing outdoor eating surface. Such a body retaining mechanism includes a single and unitary elastic band contiguously abutted against an interior face of the sides and traveling along an entire length of the perimeter.

The body retaining mechanism conveniently further includes a centrally located anchor strap with a fixed longitudinal length, which is statically coupled to a bottom surface of the body. A plurality of elastic primary straps is adjustably and dynamically positioned along the bottom surface of the body. Each of such primary straps includes a plurality of mutually exclusive tracks registered parallel to each other and formed along a longitudinal length of the primary straps respectively.

The body retaining mechanism further includes a plurality of elastic looped brackets statically and directly coupled to the elastic band and advantageously extending inwardly towards the anchor strap, and a plurality of fasteners directly attached to opposed ends of each of the primary straps respectively. Each of such fasteners are removably affixed to selected ones of the looped brackets and selected portions of the anchor strap respectively such that the primary straps linearly extend between the elastic band and the anchor strap to thereby prohibit the edges of the body from being displaced away from the anchor strap when wind blows against the body.

The body retaining mechanism further includes a plurality of elastic auxiliary straps slidably connected to selected ones of the primary straps such that each of the auxiliary straps is slidably adapted along a linear travel path defined along a partial longitudinal length of the selected primary straps when wind blows against the body. Selected ones of the fasteners are effectively connected to distal ends of the auxiliary straps and removably affixed to the looped brackets respectively such that each of the auxiliary bands are registered along a unique direction extending away from the selected primary straps respectively. Further, each of the auxiliary straps are non-overlapping and oriented along mutually exclusive directions obliquely offset from corresponding ones of the primary straps for prohibiting the edges from flapping when wind blows against the body. Proximal ends of each of the auxiliary straps are mated with the tracks such that the proximal ends of the auxiliary straps are linearly biased along the tracks while the distal ends of the auxiliary straps are statically anchored to the looped brackets respectively when wind blows against the body.

A method for maintaining a tensioned tablecloth firmly fitted on an existing outdoor eating surface during inclement weather conditions includes the steps of: providing a flexible and unitary body with a plurality of monolithically formed sides configured in such a manner to form a continuous perimeter extending about the body; positioning the body on a top surface of the existing outdoor eating surface; and retaining the body at a substantially flat and taut position during inclement weather conditions such that the body is prohibited from undesirably disengaging a top surface of the existing outdoor eating surface.

The method further includes the steps of: providing and contiguously abutting a single and unitary elastic band against an interior face of the sides such that the elastic band travels along an entire length of the perimeter; providing and statically coupling a centrally located anchor strap with a fixed longitudinal length to a bottom surface of the body; providing a plurality of elastic primary straps; adjustably and dynamically positioning the primary straps along the bottom surface of the body; providing a plurality of elastic looped brackets; statically and directly coupling the looped brackets to the elastic band by extending the looped brackets inwardly towards the anchor strap; providing and directly attaching a plurality of fasteners to opposed ends of each of the primary straps respectively; linearly extending the primary straps between the elastic band and the anchor strap respectively by removably affixing each of the fasteners to selected ones of the looped brackets and selected portions of the anchor strap respectively; and prohibiting the edges of the body from displacing away from the anchor strap when wind blows against the body.

The method further includes the steps of: providing and slidably connecting a plurality of elastic auxiliary straps to selected ones of the primary straps; and when wind blows against the body, slidably adapting each of the auxiliary straps along a linear travel path defined along a partial longitudinal length of the selected primary straps.

The method further includes the steps of: connecting selected ones of the fasteners to distal ends of the auxiliary straps; removably affixing the selected fasteners to the looped brackets respectively; and registering each of the auxiliary bands along a unique direction extending away from the selected primary straps respectively.

The method further includes the steps of: providing, forming and registering a plurality of mutually exclusive tracks along respective longitudinal lengths of the primary straps; mating proximal ends of each of the auxiliary straps with the tracks; and when wind blows against the body, linearly biasing the proximal ends of the auxiliary straps along the tracks while the distal ends of the auxiliary straps are statically anchored to the looped brackets respectively.

The method further includes the steps of: prohibiting the edges from flapping when wind blows against the body by orienting each of the auxiliary straps along mutually exclusive and non-overlapping directions and further by obliquely offsetting the auxiliary straps from corresponding ones of the primary straps.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the application of the invention, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 6 is another side elevational view of the tensioned tablecloth, showing the alternate side of the present invention.

DETAILED DESCRIPTION OF THE INVENTION

Figure 1:
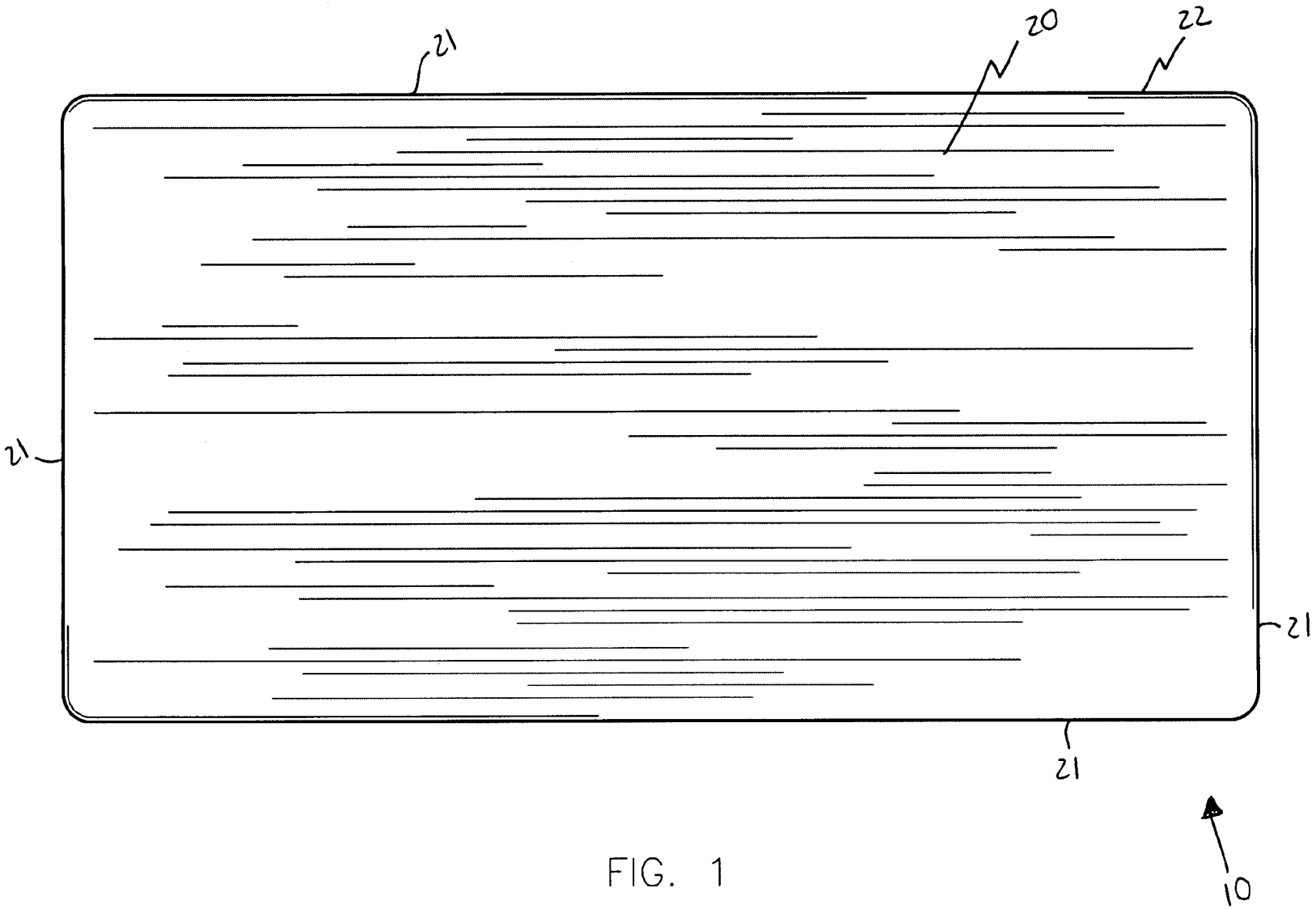
FIG. 1 is a top plan view of a tensioned tablecloth, in accordance with the present invention.
Figure 2:
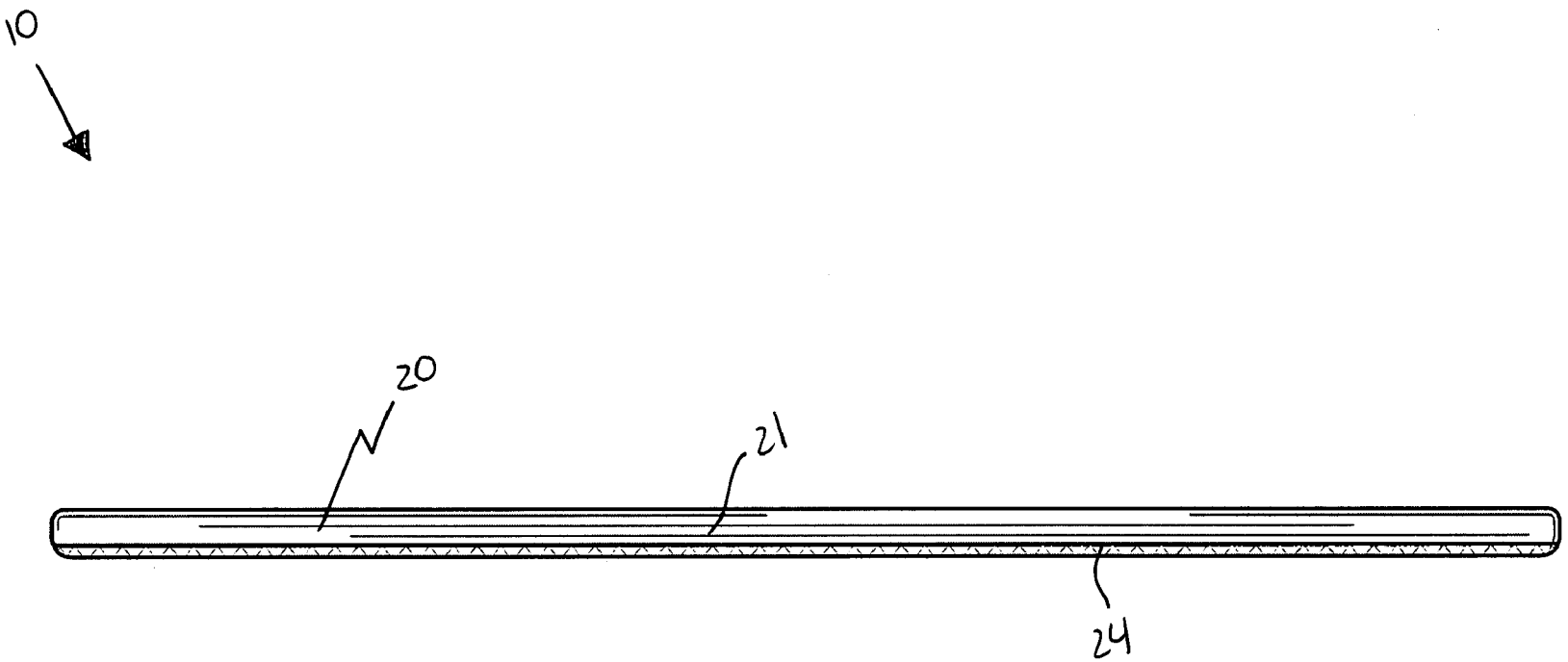
FIG. 2 is a front elevational view of the tensioned tablecloth as seen in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The present invention is referred to generally in FIGS. 1-7 by the reference numeral 10 and is intended to provide a tensioned tablecloth. It should be understood that the present invention 10 may be used to cover many different types of tables and should not be limited to covering only those types of tables mentioned herein.

Referring initially to FIGS. 1, 2, 3, 4, 5, 6 and 7, a tensioned tablecloth 10 includes a flexible and unitary body 20 with a plurality of monolithically formed sides 21 configured in such a manner to form a continuous perimeter 22 extending about the body 20. The present invention 10 further includes a mechanism 23 for retaining the body 20 at a substantially flat and taut position during inclement weather conditions which is essential such that the body 20 is prohibited from undesirably disengaging a top surface of the existing outdoor eating surface 11. Such a body retaining mechanism 23 includes a single and unitary elastic band 24 contiguously abutted against an interior face 25 of the sides 21 and traveling along an entire length of the perimeter 22. The combination of the body and the body retaining mechanism provides the unpredictable and unexpected result of ensuring that the present invention 10 remains securedly abutted directly against the surface of an existing outdoor table.

Figure 3:
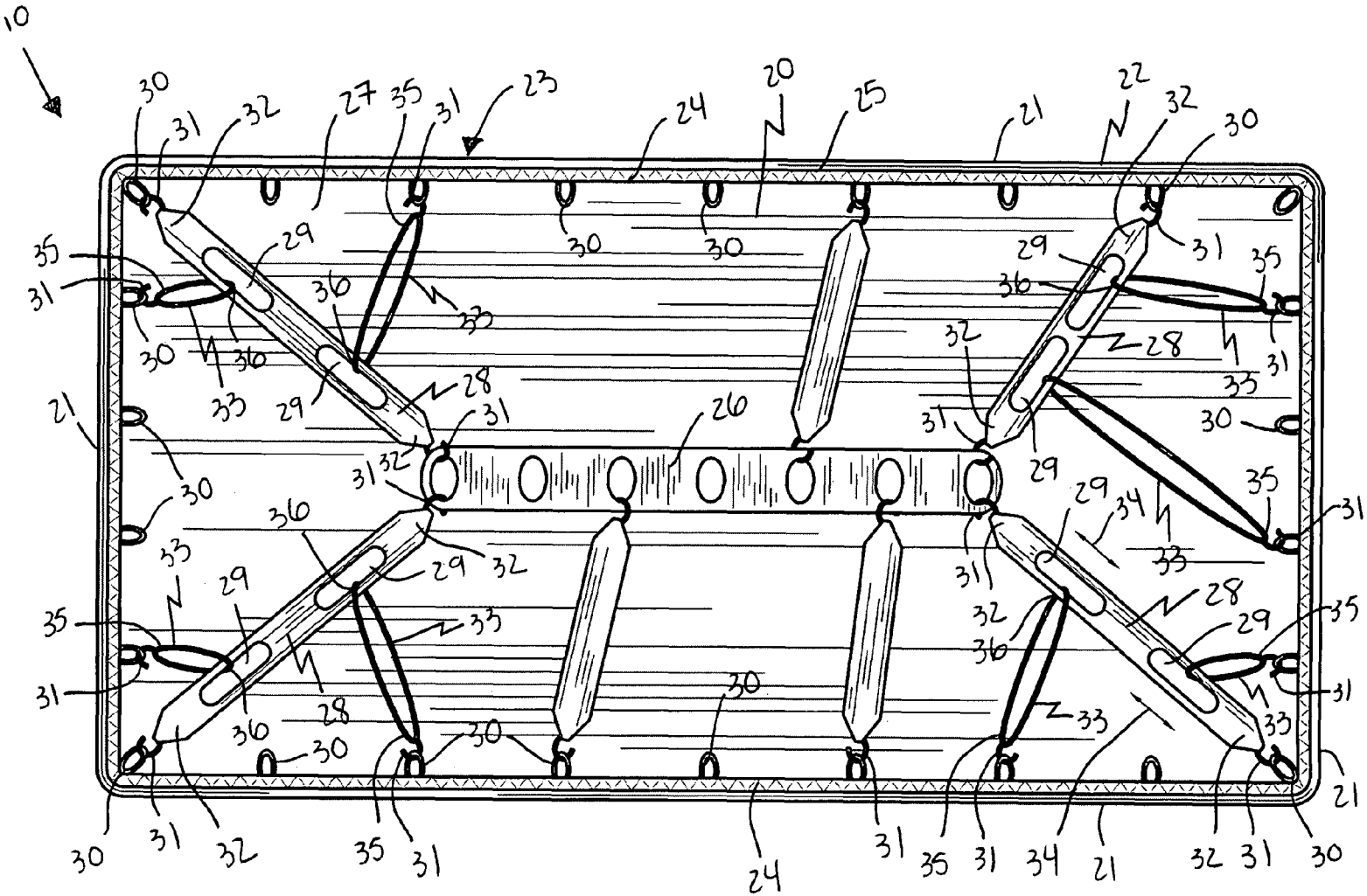
FIG. 3 is a bottom plan view of the tensioned tablecloth showing the body retaining mechanism, in accordance with the present invention.
Figure 4:
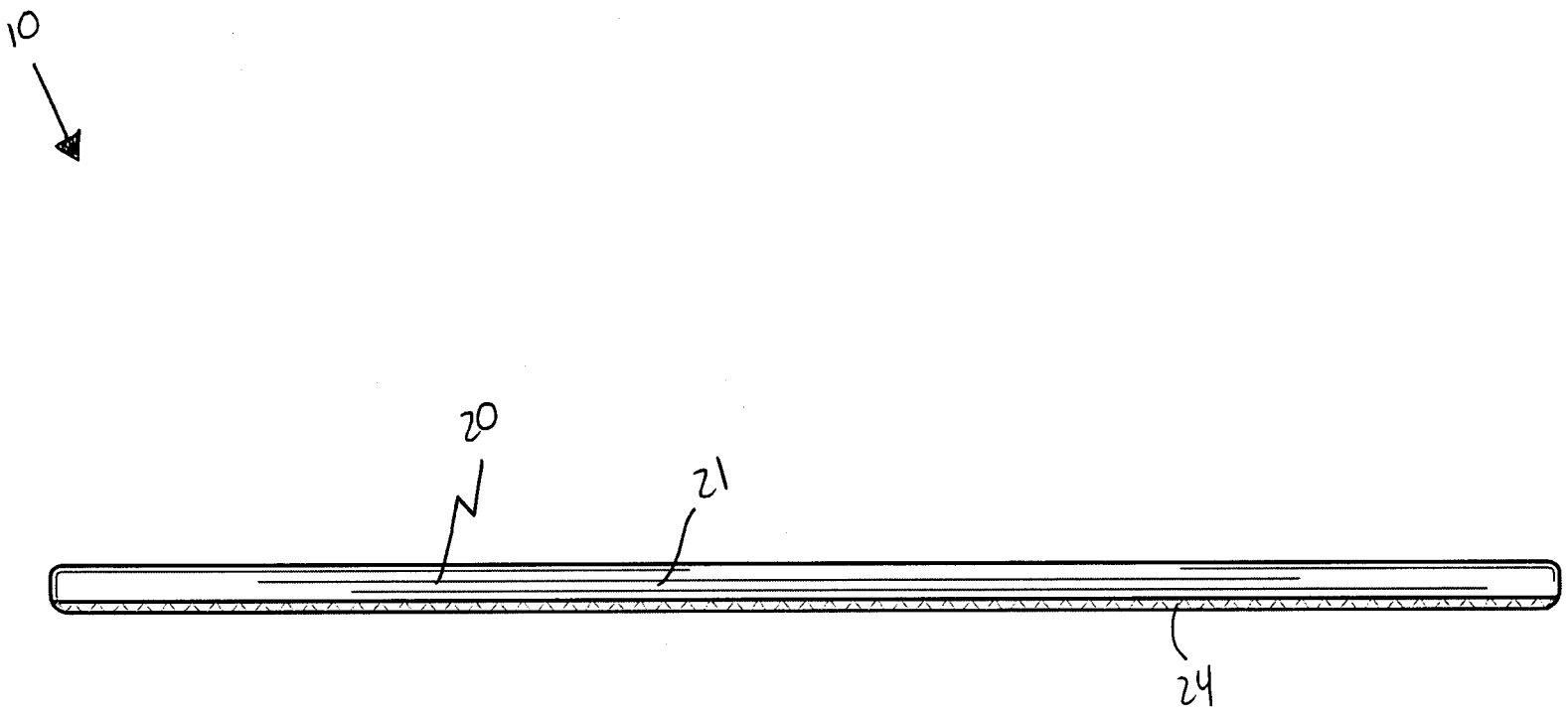
FIG. 4 is a rear elevational view of the tensioned tablecloth as seen in FIG. 1.
Figure 5:
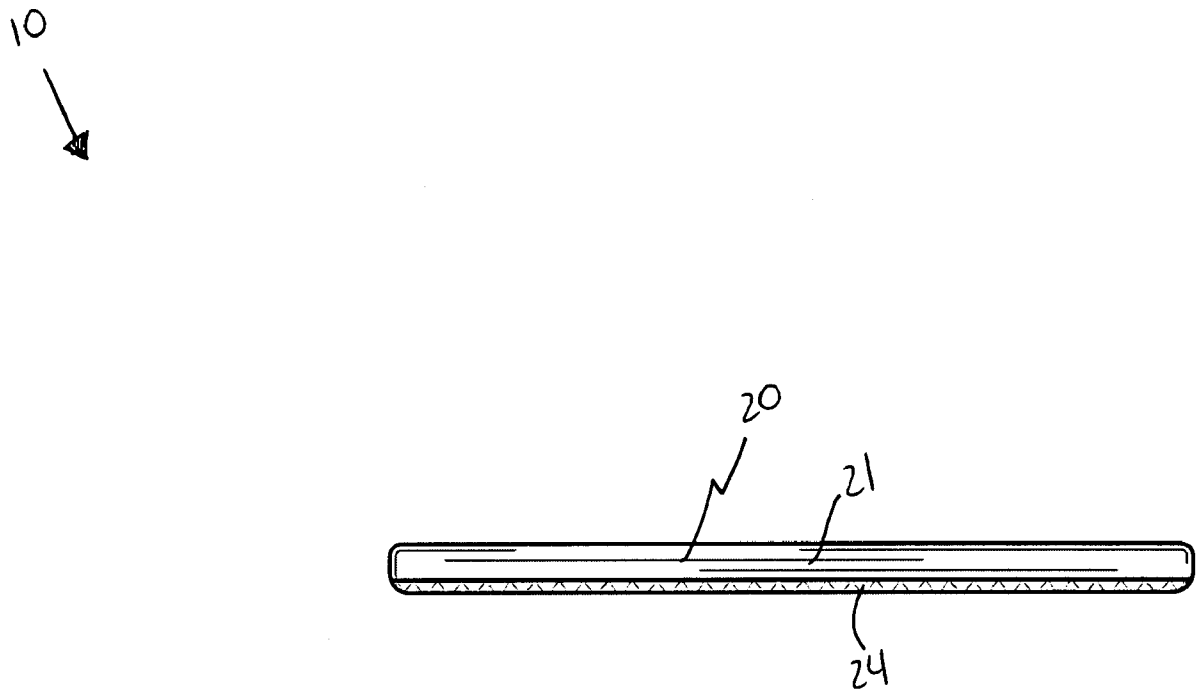
FIG. 5 is a side elevational view of the tensioned tablecloth as seen in FIG. 1.
Figure 7:
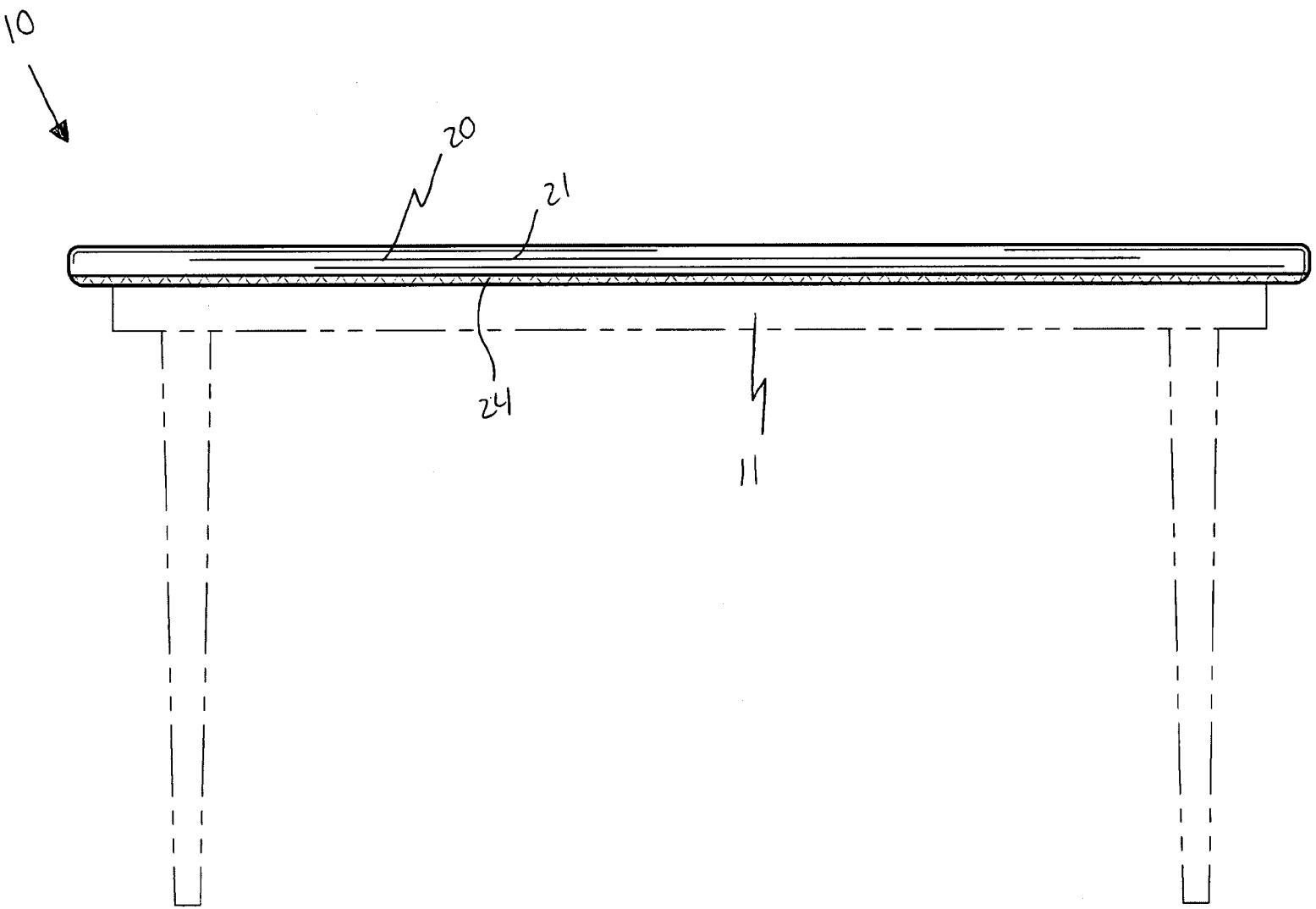
FIG. 7 is a side elevational view of the tensioned tablecloth in use with an existing table.

Referring to FIG. 3, the body retaining mechanism 23 further includes a centrally located anchor strap 26 with a fixed longitudinal length, which is statically coupled to a bottom surface 27 of the body 20. A plurality of elastic primary straps 28 is adjustably and dynamically positioned along the bottom surface 27 of the body 20. Each of such primary straps 28 includes a plurality of mutually exclusive tracks 29 registered parallel to each other and formed along a longitudinal length of the primary straps 28 respectively.

The body retaining mechanism 23 further includes a plurality of elastic looped brackets 30 statically and directly coupled, without the use of intervening elements, to the elastic band 24 and extending inwardly towards the anchor strap 26, and a plurality of fasteners 31 directly attached, without the use of intervening elements, to opposed ends 32 of each of the primary straps 28 respectively. Each of such fasteners 31 are removably affixed to selected ones of the looped brackets 30 and selected portions of the anchor strap 26 respectively which is crucial such that the primary straps 28 linearly extend between the elastic band 24 and the anchor strap 26 to thereby prohibit the edges of the body 20 from being displaced away from the anchor strap 26 when wind blows against the body 20. The combination of the anchor strap 26, primary straps 28, looped brackets 30 and fasteners 31 provide the unexpected and unpredictable benefit of enabling the present invention 10 to be adjusted to fit preexisting tables of various designs and sizes, while still maintaining the present invention 10 in a secure position against the existing table 11.

The body retaining mechanism 23 further includes a plurality of elastic auxiliary straps 33 slidably connected to selected ones of the primary straps 28 which is important such that each of the auxiliary straps 33 is slidably adapted along a linear travel path 34 defined along a partial longitudinal length of the selected primary straps 28 when wind blows against the body 20. Selected ones of the fasteners 31 are connected to distal ends 35 of the auxiliary straps 33 and removably affixed to the looped brackets 30 respectively which is vital such that each of the auxiliary bands 33 are registered along a unique direction extending away from the selected primary straps 28 respectively.

Further, each of the auxiliary straps 33 are non-overlapping and oriented along mutually exclusive directions obliquely offset from corresponding ones of the primary straps 28 for prohibiting the edges from flapping when wind blows against the body 20. Proximal ends 36 of each of the auxiliary straps 33 are mated with the tracks which are crucial such that the proximal ends 36 of the auxiliary straps 33 are linearly biased along the tracks while the distal ends 35 of the auxiliary straps 33 are statically anchored to the looped brackets 30 respectively when wind blows against the body 20.

The present invention includes a body that has elastic edges monolithically formed therewith, which is crucial for securely attaching the body to the top surface of a table and preventing same from being lifted by the wind. The body may be produced from lightweight yet durable materials, including plastic, vinyl and machine washable cotton, for example. Of course, the present invention could be produced in a variety of shapes and sizes to accommodate various standard outdoor picnic and patio tables, as is obvious to a person of ordinary skill in the art. A unitary elastic band runs along the entire perimeter of the cover's body. Of course, alternate attaching means, like a simple drawstring closure which expands the border of the body, could be employed, as is obvious to a person of ordinary skill in the art. Of course, the present invention could be produced in a wide variety of appealing colors and printed designs, as is obvious to a person of ordinary skill in the art.

The present invention, as claimed, provides the unexpected and unpredictable benefit that is convenient and easy to use, is durable yet lightweight in design, is versatile in its applications, and provides users with a practical way in which to maintain a neat and flat table cover, particularly when dining outdoors. Having an integrated elastic band, the present invention ensures that regardless of wind or activity, the body remains safely anchored to the table in a neat fashion. Users appreciate that by utilizing the present invention as opposed to conventional table covers, the risk of food and beverages toppling over are effectively eliminated. By preventing those aggravating mishaps which so often occur when a table cover billows or flows away in the wind, the present invention makes the experience of dining outdoors far more enjoyable. The present invention appeals to restaurants and catering companies in addition to home owners.

In use, a method for maintaining a tensioned tablecloth firmly fitted on an existing outdoor eating surface during inclement weather conditions includes the steps of: providing a flexible and unitary body 20 with a plurality of monolithically formed sides 21 configured in such a manner to form a continuous perimeter 22 extending about the body 20; positioning the body 20 on a top surface of the existing tablecloth; and retaining the body 20 at a substantially flat and taut position during inclement weather conditions such that the body 20 is prohibited from undesirably disengaging a top surface of the existing outdoor eating surface 11.

In use, the method further includes the steps of: providing and contiguously abutting a single and unitary elastic band 24 against an interior face of the sides such that the elastic band 24 travels along an entire length of the perimeter 22; providing and statically coupling a centrally located anchor strap 26 with a fixed longitudinal length to a bottom surface 27 of the body 20; providing a plurality of elastic primary straps 28; adjustably and dynamically positioning the primary straps 28 along the bottom surface 27 of the body 20; providing a plurality of elastic looped brackets 30; statically and directly coupling, without the use of intervening elements, the looped brackets 30 to the elastic band 24 by extending the looped brackets 30 inwardly towards the anchor strap 26; providing and directly attaching, without the use of intervening elements, a plurality of fasteners 31 to opposed ends 32 of each of the primary straps 28 respectively; linearly extending the primary straps 28 between the elastic band 24 and the anchor strap 26 respectively by removably affixing each of the fasteners 31 to selected ones of the looped brackets 30 and selected portions of the anchor strap 26 respectively; and prohibiting the edges of the body 20 from displacing away from the anchor strap 26 when wind blows against the body 20.

In use, the method further includes the steps of: providing and slidably connecting a plurality of elastic auxiliary straps 33 to selected ones of the primary straps 28; and when wind blows against the body 20, slidably adapting each of the auxiliary straps 33 along a linear travel path defined along a partial longitudinal length of the selected primary straps 28.

In use, the method further includes the steps of: connecting selected ones of the fasteners 31 to distal ends 35 of the auxiliary straps 33; removably affixing the selected fasteners 31 to the looped brackets 30 respectively; and registering each of the auxiliary bands 33 along a unique direction extending away from the selected primary straps 28 respectively.

In use, the method further includes the steps of: providing, forming and registering a plurality of mutually exclusive tracks 29 along respective longitudinal lengths of the primary straps 28; mating proximal ends 36 of each of the auxiliary straps 33 with the tracks 29; and when wind blows against the body 20, linearly biasing the proximal ends 36 of the auxiliary straps 33 along the tracks 29 while the distal ends 35 of the auxiliary straps 33 are statically anchored to the looped brackets 30 respectively.

In use, the method further includes the steps of: prohibiting the edges from flapping when wind blows against the body 20 by orienting each of the auxiliary straps 33 along mutually exclusive and non-overlapping directions and further by obliquely offsetting the auxiliary straps 33 from corresponding ones of the primary straps 28.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A tensioned tablecloth for remaining firmly fitted on an existing outdoor eating surface during inclement weather conditions, said tensioned tablecloth comprising:

a body having a plurality of sides configured in such a manner to form a continuous perimeter extending about said body; and means for retaining said body at a substantially flat and taut position during inclement weather conditions such that said body is prohibited from undesirably disengaging a top surface of the existing outdoor eating surface;

wherein said body retaining means comprises: a single and unitary elastic band contiguously abutted against an interior face of said sides and traveling along an entire length of said perimeter;

a centrally located anchor strap having a fixed longitudinal length and being statically coupled to a bottom surface of said body;

a plurality of elastic primary straps adjustably and dynamically positioned along said bottom surface of said body;

a plurality of elastic looped brackets statically and directly coupled to said elastic band and extending inwardly towards said anchor strap; and a plurality of fasteners directly attached to opposed ends of each of said primary straps respectively;

wherein each of said fasteners are removably affixed to selected ones of said looped brackets and selected portions of said anchor strap respectively such that said primary straps linearly extend between said elastic band and said anchor strap to thereby prohibit said edges of said body from being displaced away from said anchor strap when wind blows against said body.

2. The tablecloth of claim 1, wherein said body retaining means further comprises:

a plurality of elastic auxiliary straps slidably connected to selected ones of said primary straps such that each of said auxiliary straps is slidably adapted along a linear travel path defined along a partial longitudinal length of said selected primary straps when wind blows against said body.

3. The tablecloth of claim 2, wherein selected ones of said fasteners are connected to distal ends of said auxiliary straps and removably affixed to said looped brackets respectively such that each of said auxiliary bands are registered along a unique direction extending away from said selected primary straps respectively.

4. The tablecloth of claim 2, wherein each of said primary straps comprises: a plurality of mutually exclusive tracks registered parallel to each other and formed along longitudinal length of said primary straps respectively, proximal ends of each of said auxiliary straps being mated with said tracks such that said proximal ends of said auxiliary straps are linearly biased along said tracks while said distal ends of said auxiliary straps are statically anchored to said looped brackets respectively when blows against said body.

5. The tablecloth of claim 2, wherein each of said auxiliary straps are non-overlapping and oriented along mutually exclusive directions obliquely offset from corresponding ones of said primary straps for prohibiting said edges from flapping when wind blows against said body.

6. A tensioned tablecloth for remaining firmly fitted on an existing outdoor eating surface during inclement weather conditions, said tensioned tablecloth comprising:

a flexible and unitary body having a plurality of monolithically formed sides configured in such a manner to form a continuous perimeter extending about said body; and means for retaining said body at a substantially flat and taut position during inclement weather conditions such that said body is prohibited from undesirably disengaging a top surface of the existing outdoor eating surface;

wherein said body retaining means comprises: a single and unitary elastic band contiguously abutted against an interior face of said sides and traveling along an entire length of said perimeter;

a centrally located anchor strap having a fixed longitudinal length and being statically coupled to a bottom surface of said body;

a plurality of elastic primary straps adjustably and dynamically positioned along said bottom surface of said body;

a plurality of elastic looped brackets statically and directly coupled to said elastic band and extending inwardly towards said anchor strap; and a plurality of fasteners directly attached to opposed ends of each of said primary straps respectively;

wherein each of said fasteners are removably affixed to selected ones of said looped brackets and selected portions of said anchor strap respectively such that said primary straps linearly extend between said elastic band and said anchor strap to thereby prohibit said edges of said body from being displaced away from said anchor strap when wind blows against said body.

7. The tablecloth of claim 6, wherein said body retaining means further comprises:

a plurality of elastic auxiliary straps slidably connected to selected ones of said primary straps such that each of said auxiliary straps is slidably adapted along a linear travel path defined along a partial longitudinal length of said selected primary straps when wind blows against said body.

8. The tablecloth of claim 7, wherein selected ones of said fasteners are connected to distal ends of said auxiliary straps and removably affixed to said looped brackets respectively such that each of said auxiliary bands are registered along a unique direction extending away from said selected primary straps respectively.

9. The tablecloth of claim 7, wherein each of said primary straps comprises:

a plurality of mutually exclusive tracks registered parallel to each other and formed along longitudinal length of said primary straps respectively, proximal ends of each of said auxiliary straps being mated with said tracks such that said proximal ends of said auxiliary straps are linearly biased along said tracks while said distal ends of said auxiliary straps are statically anchored to said looped brackets respectively when blows against said body.

10. The tablecloth of claim 7, wherein each of said auxiliary straps are non-overlapping and oriented along mutually exclusive directions obliquely offset from corresponding ones of said primary straps for prohibiting said edges from flapping when wind blows against said body.

11. A method maintaining a tensioned tablecloth firmly fitted on an existing outdoor eating surface during inclement weather conditions, said method comprising the steps of:

a. providing a flexible and unitary body having a plurality of monolithically formed sides configured in such a manner to form a continuous perimeter extending about said body;

b. positioning said body on a top surface of the existing tablecloth; and c. retaining said body at a substantially flat and taut position during inclement weather conditions such that said body is prohibited from undesirably disengaging a top surface of the existing outdoor eating surface;

wherein step c. comprises the steps of:

i. providing and contiguously abutting a single and unitary elastic band against an interior face of said sides such that said elastic band travels along an entire length of said perimeter;

ii. providing and statically coupling a centrally located anchor strap having a fixed longitudinal length to a bottom surface of said body;

iii. providing a plurality of elastic primary straps;

iv. adjustably and dynamically positioning said primary straps along said bottom surface of said body;

v. providing a plurality of elastic looped brackets;

vi. statically and directly coupling said looped brackets to said elastic band by extending said looped brackets inwardly towards said anchor strap;

vii. providing and directly attaching a plurality of fasteners to opposed ends of each of said primary straps respectively;

viii. linearly extending said primary straps between said elastic band and said anchor strap respectively by removably affixing each of said fasteners to selected ones of said looped brackets and selected portions of said anchor strap respectively; and ix. prohibiting said edges of said body from displacing away from said anchor strap when wind blows against said body.

12. The method of claim 11, further comprising the steps of:

providing and slidably connecting a plurality of elastic auxiliary straps to selected ones of said primary straps; and when wind blows against said body, slidably adapting each of said auxiliary straps along a linear travel path defined along a partial longitudinal length of said selected primary straps.

13. The method of claim 12, further comprising the steps of:

connecting selected ones of said fasteners to distal ends of said auxiliary straps;

removably affixing said selected fasteners to said looped brackets respectively; and registering each of said auxiliary bands along a unique direction extending away from said selected primary straps respectively.

14. The method of claim 12, wherein step iii. comprises the steps of:

providing and forming registering a plurality of mutually exclusive tracks along respective longitudinal lengths of said primary straps;

mating proximal ends of each of said auxiliary straps with said tracks; and when blows against said body, linearly biasing said proximal ends of said auxiliary straps along said tracks while said distal ends of said auxiliary straps are statically anchored to said looped brackets respectively.

15. The method of claim 12, further comprising the steps of:

prohibiting said edges from flapping when wind blows against said body by orienting each of said auxiliary straps along mutually exclusive and non-overlapping directions and further by obliquely offsetting said auxiliary straps from corresponding ones of said primary straps.

* * * * *